US005240492A

United States Patent [19]

Phillips et al.

[11] Patent Number: 5,240,492

[45] Date of Patent: Aug. 31, 1993

[54] METALLURGICAL FLUXES

[75] Inventors: Roy J. Phillips; James A. Moore, both of Strongsville, Ohio

[73] Assignee: Foseco International Limited, Birmingham, England

[21] Appl. No.: 866,201

[22] Filed: Apr. 9, 1992

[30] Foreign Application Priority Data

Apr. 25, 1991 [GB] United Kingdom ..... 9108889

[51] Int. Cl.[5] ..... C21C 7/00

[52] U.S. Cl. ..... 75/305

[58] Field of Search ..... 75/305

[56] References Cited

U.S. PATENT DOCUMENTS 4,127,407 11/1978 Eitel ..... 75/305

4,462,834 7/1984 LaBate ..... 106/38.28

5,028,257 7/1991 Tomkins et al. ..... 75/305

FOREIGN PATENT DOCUMENTS 2545340 4/1977 Fed. Rep. of Germany .

223378 6/1985 Fed. Rep. of Germany .

60-258406 12/1985 Japan .

*Primary Examiner*—Peter D. Rosenberg

*Attorney, Agent, or Firm*—Nixon & Vanderhye

[57] ABSTRACT

A metallurgical flux is provided as bonded particulates in granular or briquette form, which contains fluxing ingredients, binder and an expanding agent whereby action of heat in contact with molten metal causes expansion of the expanding agent to break down the bonded particulates into particulate form.

18 Claims, No Drawings

METALLURGICAL FLUXES

This invention relates to metallurgical fluxes which are used to cover molten metal in metallurgical vessels. Thus, they may be used, for example, as ladle covers but are particularly useful as covers for molten steel in tundishes in the continuous casting of steel.

In the continuous casting of steel a tundish is used as an intermediate vessel between a ladle and a mould to provide a reservoir of molten metal, and to distribute the molten steel to the mould. In recent times steelmakers have investigated the tundish, not only as a reservoir provider and distributor, but also as a vessel in which non-metallic oxide inclusions such as deoxidation products (for example, solid alumina and liquid calcium aluminates) and slag carried over from the ladle can be removed from the molten steel.

It is normal practice to use calcined rice hulls or other inert powders to cover the molten steel in the tundish during the casting operation. However, although rice hulls and similar materials provide excellent thermal insulation they do not prevent aluminium reoxidation or nitrogen contamination, nor provide a means for removing non-metallic inclusions contained in the steel.

Consequently, in order to achieve the aim of producing "clean" steel in the tundish, steelmakers have started to use flux compositions containing components such as silica, calcium oxide, alumina, magnesium oxide and calcium fluoride as tundish covers. For example, Japanese Unexamined Patent Publication No. 60-258406 describes the use as a tundish cover of a flux composition containing 3% by weight carbon, 5–15% by weight silica, 5–20% by weight alumina, 30–60% by weight calcium oxide, 5–20% magnesium oxide and 10–40% by weight calcium fluoride.

Previous fluxes, although capable of preventing reoxidation and of absorbing inclusions from the steel and of providing sufficient thermal insulation to prevent steel skulling, have the serious disadvantage that they are mixtures of fine powders. Their use inevitably, therefore, generates airborne dust particles, which is clearly environmentally undesirable.

Non-dusting cover materials, such as expanded clays, have been proposed but have not provided an overall satisfactory solution to the problem, particularly in that the chemistry of these materials can result in unsatisfactorily-cleaned steels.

The present invention aims to provide a flux which overcomes the dust problem while retaining the good chemical and thermal insulation properties of known fluxes.

Accordingly, the invention provides a metallurgical flux containing fluxing ingredients, binder and an expanding agent, the flux being in the form of bonded particules preferably in granular or briquette form, which bonded particulates are broken down to particulate form by expansion of the expanding agent under heat Thus, the granules or briquettes, when applied to the surface of a molten metal, expand due to the effect of the heat of the metal on the expanding agent and thereby disintegrate back to their particulate or powder constituents in-situ.

The invention, therefore, overcomes the dust problem in a most effective way while retaining not only the chemical and inclusion-removal properties of the flux composition used but also retaining the good thermal insulation characteristics of the flux powder composition whereas use of the granular or briquette form without the expansion agent and its associated disintegrating action would not provide such good thermal insulation.

The bonded particulates may be formed into briquette or granular form by any suitable techniques. Briquetting techniques of high pressure compaction are, of course, well known. Suitable granules may formed by spray drying or pan granulation, for example. The latter is preferred as less costly and less restrictive of materials than the water-slurry route of spray drying.

The preferred minimum size of the bonded particulates is 0.5 mm diameter and the preferred maximum size., in briquette form, is about 50×40×20 mm.

Any suitable expanding agent may be used, for example, expandable perlite, expandable, e.g. acid-treated, graphite or expandable vermiculite. The expanding agent is preferably used in an amount of from 0.5 to 10% by weight of the bonded particulate product, preferably from 1 to 6% by weight.

The binder may be any suitable binder material that will maintain the integrity of the bonded particulates from manufacture through storage, transport and use up to the point of expansion of the expanding agent when, of course, it is necessary for the product to disintegrate back to its original powder form. Examples of suitable binders include Acrawax, supplied by Glycochem and of the formula $H_{35}$ $C_{17}$ COH $NC_2H_4NHCOC_{17}H_{35}$, molasses and stearic acid. The binder is preferably used in an amount of from 0.5 to 10% by weight of the bonded particulate product.

The other constituents of the flux composition may be any suitable materials, e.g. as are conventionally used, and the bonded particulates may be formulated to achieve the maximum desired effect for any particular situation For example, the composition may be formulated to have the following chemical content by weight:-

| | |
|---|---|
| MgO | 0 to 95% |
| $Al_2O_3$ | 0 to 30% |
| $CaO/SiO_2$ | balance |
| binder | 0.5 to 10% |
| expanding agent | 0.5 to 10%. |

Of course, other ingredients, including other fluxes, may optionally be included, if desired, e.g. calcium fluoride (spar) and soda ash.

It is preferred that the $CaO:SiO_2$ ratio in the composition be at least 0.6:1 and silica-free formulations may also be used, if desired, i.e. in which the only possible silica inclusion would be in the form of contamination in the various raw materials used. Minor amounts of other impurities, e.g. sodium oxide and iron oxide, may also be present from the raw materials used.

The compositions used as the basis of the flux composition may also be as described in our U.S. Pat. No. 5028257. This describes a flux composition which contains more magnesium oxide than has hitherto been used, the composition containing from 22 to 35% by weight of magnesium oxide and having a weight ratio of calcium oxide to magnesium oxide of from 0.6 to 2.5:1. Such a composition may be formulated with binder and expanding agent for use in the present invention.

If desired, the flux composition of the invention may also contain a proportion of non-expandable carbon, such as graphite, us ally in an amount of from 3 to 8% by weight. This improves the flowability of the flux composition, improves its thermal insulation properties and helps to prevent the composition from sintering and crusting when applied to the surface of molten steel The calcium oxide content of the flux composition may be provided by the use of materials such as lime chippings, limestone or calcined dolomitic lime, and the magnesium oxide content may be provided by materials such as dead burnt magnesite or calcined dolomitic lime. The alumina, which is included as a fluxing agent to lower the melting point of the flux composition, is, preferably added in the form of calcined alumina or perlite. As perlite has a relatively low density compared with the other raw materials used to produce the flux composition, it has the effect of reducing the overall density of the composition and improving the thermal insulation properties of the composition in use. Perlite will also provide or contribute to the silica content of the composition. Some silica is also present in dead burnt magnesite.

When used as a tundish cover, the bonded particulate flux is applied to the surface of molten steel in the tundish at the beginning of the casting operation, usually at the rate of about 0.8 to 1.2 lb per ton of steel cast. During casting, as subsequent heats of steel are cast, further amounts of the flux should be added at lower addition rates.

The invention is further described by way of illustration only in the following example.

EXAMPLE

Briquettes of approximate dimensions 45×25×20 mm were compacted under high pressure from a mixture containing 1% by weight of Acrawax binder, 4% of acid treated graphite and sufficient lime or dolomitic lime, perlite, bauxite, alumina, diatomaceous earth and magnesite to produce a formulation containing 57% by weight CaO, 28% by weight MgO, 8% by weight $SiO_2$ and 3% by weight $Al_2O_3$.

Thus, a handleable, dust-free flux, readily powderable in contact with molten metal was provided.

We claim:

1. A metallurgical flux comprising fluxing ingredients, binder and an expanding agent, in the form of bonded particulates which are mixed and bound together so that said bonded particulate flux breaks down into particulate form when subjected to heat of molten metal, by expansion of the expanding agent, wherein the minimum size of the bonded particles is 0.5 mm diameter, and the maximum size in briquette form, is about 50×40×20 mm.

2. A metallurgical flux according to claim 1, in which the bonded particulates are in the form of briquettes.

3. A metallurgical flux according to claim 1, in which the bonded particulates are in the form of granules.

4. A metallurgical flux according to claim 1, in which the expanding agent is selected from the class consisting of expandable perlite, graphite and vermiculite.

5. A metallurgical flux according to claim 1, in which the expanding agent is present in an amount of from 0.5 to 10% by weight of the bonded particulate.

6. A metallurgical flux according to claim 5, in which the expanding agent is present in an amount of from 1 to 6% by weight of the bonded particulate.

7. A metallurgical flux according to claim 1, in which the binder is present in an amount of from 0.5 to 10% by weight of the bonded particulate.

8. A metallurgical flux according to claim 1, in which the binder is selected from the class consisting of molasses and stearic acid.

9. A metallurgical flux according to claim 1, in which the fluxing ingredients include calcium oxide and silica in a $CaO:SiO_2$ ratio of at least 0.6:1.

10. A metallurgical flux according to claim 1, in which the fluxing ingredients include calcium oxide and magnesium oxide in a CaO:MgO ratio of 0.6 to 2.5:1.

11. A metallurgical flux according to claim 1, in which the flux contains non-expandable carbon in an amount of from 3 to 8% by weight of the bonded particulate.

12. A metallurgical flux according to claim 2, in which the fluxing ingredients include calcium oxide and silica in a $CaO:SiO_2$ ratio of at least 0.6:1.

13. A metallurgical flux according to claim 2, in which the fluxing ingredients include calcium oxide and magnesium oxide in a CaO:MgO ratio of 0.6 to 2.5:1.

14. A metallurgical flux according to claim 2, in which the flux contains non-expandable carbon in an amount of from 3 to 8% by weight of the bonded particulate.

15. A metallurgical flux according to claim 5, in which the fluxing ingredients include calcium oxide and silica in a $CaO:SiO_2$ ratio of at least 0.6:1.

16. A metallurgical flux according to claim 5, in which the fluxing ingredients include calcium oxide and magnesium oxide in a CaO:MgO ratio of 0.6 to 2.5:1.

17. A metallurgical flux according to claim 5, in which the flux contains non-expandable carbon in an amount of from 3 to 8% by weight of the bonded particulate.

18. A metallurgical flux according to claim 7, in which the binder is present in an amount of from 0.5 to 10% by weight of the bonded particulate.

* * * * *